US006109979A

United States Patent [19]

Garnett

[11] Patent Number: 6,109,979

[45] Date of Patent: Aug. 29, 2000

[54] EXPLOSION PROOF FEEDTHROUGH CONNECTOR

[75] Inventor: Robert Barclay Garnett, Arvada, Colo.

[73] Assignee: Micro Motion, Inc., Boulder, Colo.

[21] Appl. No.: 08/961,786

[22] Filed: Oct. 31, 1997

[51] Int. Cl.[7] ..... H01R 9/22

[52] U.S. Cl. ..... 439/709; 439/573; 439/936

[58] Field of Search ..... 439/589, 709, 439/719, 936, 276, 527, 544, 569, 573

[56] References Cited

U.S. PATENT DOCUMENTS

| | | | |
|---|---|---|---|
| 4,213,018 | 7/1980 | Piston | 439/181 X |
| 5,326,285 | 7/1994 | Maros | 439/717 |
| 5,399,807 | 3/1995 | Yarbrough et al. . | |

FOREIGN PATENT DOCUMENTS

| | | |
|---|---|---|
| 0 309 895 A2 | 4/1989 | European Pat. Off. . |
| 3911901 A1 | 10/1990 | Germany . |
| 42 08 285 | 9/1993 | Germany . |
| 2 208 191 | 3/1989 | United Kingdom . |

OTHER PUBLICATIONS

Pave Technology Inc. "Hermatically Sealed Wire Pave–Seal Harnesses, Pave–Mate Connectors and Pave–Flex Circuits", 1993, pp. 4–6 and 10–11.

Stahl Product Catalog, Chapter 7, pp. 7/16–7/20 and 7/22–7/28.

Bartec, "Bartec Catalogue Edition 1995/1996", 1995, p. 4/4.

Bosha, Information Flier, 1995, shows feed–through connectors.

*Primary Examiner*—Khiem Nguyen

*Attorney, Agent, or Firm*—Duft, Graziano & Forest, P.C.

[57] ABSTRACT

An apparatus for providing a connection between circuits inside an explosion proof compartment and circuits outside of the explosion proof compartment. A feedthrough connector of the present invention is made of explosion proof material and is fabricated to fit securely in an opening of the explosion proof compartment. A terminal housing on the exterior surface of the feedthrough connector has partitions separating the terminals to prevent a spark from being created due to adjacent ones of said terminal contacting each other.

11 Claims, 4 Drawing Sheets

EXPLOSION PROOF FEEDTHROUGH CONNECTOR

FIELD OF THE INVENTION

The present invention relates to a connector which extends circuits inside an explosion proof compartment to terminals outside of the compartment. More particularly, the present invention relates to a feedthrough connector that fits securely inside an opening in an explosion proof compartment to prevent a flame or an internal explosion from escaping through or around the feedthrough connector. Still more particularly, the present invention relates to an explosion proof feedthrough connector that prevents arcing between exterior terminals on the feedthrough connector.

PROBLEM

Some industrial environments have an explosive atmosphere. A spark of sufficient energy in these environments can ignite an explosion. One potential source of these sparks is circuitry used to perform and monitor certain operations in these environments. Some circuits, such as a motor, inherently generate sparks during their operation. These inherently sparking circuits are typically enclosed in an explosion proof compartment to prevent a spark created inside the compartment from igniting the atmosphere outside of the compartment.

It is a problem to extend connections from the inherently sparking circuits inside the explosion proof compartment to terminals outside the compartment. In order to extend the connections from the inherently sparking circuits to the terminals, a feedthrough connector must pass through a wall in the explosion proof compartment without compromising the integrity of the compartment. There are two different types of feedthrough connectors which are commonly used with explosion proof compartments. The first feedthrough connector type comprises a plurality of conductors that are potted into a wall of the compartment. The second type is a cylindrical feedthrough connector that is threaded or slip fitted into an opening in the compartment. Both of these feedthrough connector types have several disadvantages associated with their use.

One disadvantage of potting conductors in a wall of an explosion proof compartment is that it is a difficult process to properly pot the conductors. The conductors must be held in place while a potting material is injected into the wall of compartment and cured. Any movement of the conductors before the potting material is cured results in the conductors being improperly set. Extra time and equipment are required to ensure that the conductors are properly set.

Another disadvantage of potting conductors into a wall of the compartment is that after the potting material has been cured, the position of the conductors cannot be changed since the potting material cannot be easily removed or reformed. If a conductor becomes defective or the potting material does not cure properly, the entire housing containing the compartment must be discarded. This is a waste of material and can be expensive. A further disadvantage of potting conductors into a wall of an explosion proof compartment is that there are limited housing configurations which permit an easy connection of conductors with circuits inside the compartment. In order to facilitate a connection with the internal circuits, the conductors must be in easily accessible areas of the compartment. The placement of the conductors in accessible areas is a limiting factor in the manufacture of such a compartment.

A cylindrical feedthrough connector is threaded or slip fitted into a mated opening in an explosion proof compartment. Several disadvantages or a cylindrical feedthrough connector can be attributed to the type of conductor used in the feedthrough. Typically, discrete wires or solid conductors, such as pins, are used as the conductors in cylindrical feedthrough connectors.

A disadvantage of discrete wires in the cylindrical feedthrough connector is that the discrete wires do not facilitate automated production techniques. Each discrete wire must be attached to a terminal or other type of connector in an explosion proof compartment. This adds to the hardware needed inside the explosion proof compartment. Further, the connection of the discrete wires to the terminals is labor intensive.

A disadvantage of rigid conductors in a cylindrical feedthrough connector is that the rigid conductors may need to be oriented to facilitate a connection with the proper circuit. An additional mechanism is required to perform the orientation. Further, the cylindrical feedthrough connector must be located in an explosion proof compartment in an area that is easily accessible to facilitate the orientation.

Another disadvantage of using rigid conductors is the round shape of the feedthrough connector is not space efficient which limits the number of rigid conductors in the cylindrical feedthrough connector. Further, the locations of terminals for the rigid conductors on the cylindrical feedthrough connector are not convenient for field wiring.

An additional problem with explosion proof feedthrough connectors is that sometimes circuits on the exterior of the housing have a high enough energy level to create a spark when adjacent leads to the feedthrough connector come into close proximity. Therefore, measures should be taken to prevent arcing between leads.

SOLUTION

The above and other problems are solved and an advance in the art is achieved by the present invention which relates to the provision of an explosion proof feedthrough connector. In accordance with the present invention, a feedthrough connector is fabricated to fit securely into an opening in an explosion proof compartment to prevent an explosion or flame inside the compartment from escaping through or around the feedthrough connector. The feedthrough connector, in accordance with the present invention, also isolates each of the terminals on the exterior side of the feedthrough connector from each other to prevent the creation of a spark between adjacent terminals. The present invention also relates to a feedthrough connector with a shape that optimizes the number of terminals as well as provides an inherent orientation.

The feedthrough connector provided by the present invention has three main elements: a plurality of conductors, a terminal housing, and an explosion proof base. Each of the conductors has a terminal on a first exterior end of the conductor. A shaft on a second interior end of each conductor extends through mated openings in the terminal housing and explosion proof base and protrudes into the interior of an explosion proof compartment.

A terminal housing made of nonconductive material is affixed to the exterior side of the explosion proof base. A plurality of openings through the terminal housing receive the conductors, which are driven into the openings of the terminal housing to secure the conductors in place. A terminal of each conductor remains above the surface of the terminal housing to connect to external circuits. The openings can be arranged on the surface of the terminal housing in a manner that maximizes the number of terminals on the housing.

In order to prevent an explosion in the exterior environment, the terminal housing isolates each terminal from adjacent terminals to prevent the creation of sparks. U-shaped partitions around each terminal prevent a lead detached from a terminal from coming into contact with another lead. The unshaped partitions are defined by a central wall between each row of pins and divider walls between adjacent openings in each row.

An explosion proof base of the feedthrough connector is made of a material that can withstand the stress caused by an explosion and fits into an opening in the an explosion proof compartment. A face plate of the explosion proof base is affixed to an exterior wall of the explosion proof compartment. The terminal housing is affixed to a top surface of the face plate of the explosion proof base. A feedthrough boss of the explosion proof base protrudes from a bottom surface of the face plate and fits securely into the opening in the explosion proof compartment. The feedthrough boss extends into the interior of the explosion proof compartment. The feedthrough boss is fabricated to fit in the explosion proof compartment with a minimal gap between the explosion proof compartment and the feedthrough boss to prevent a flame or an explosion from escaping through the gap to the outside environment. Openings through the entirety of the explosion proof base are mated to the openings in the terminal housing. The conductors extend through the openings in the terminal housing, further extend through the openings in the explosion proof base, and protrude into the interior of an explosion proof compartment. The openings in the explosion proof base are sealed by injecting a potting material into the space in the openings surrounding the conductors. The potting material prevents a flame or explosion from escaping through one of the openings.

A feedthrough connector of the present invention has the following advantages over commonly used explosion proof feedthrough connectors. The feedthrough connector of the present invention can be any shape since the explosion proof base is fabricated to fit securely into the opening in an explosion proof compartment. Terminals on the feedthrough connector provided by the present invention are arranged in a manner that optimizes the space on the feedthrough connector. Since the explosion proof feedthrough connector provided by the present invention is a separate element, a defect in the feedthrough connector does not adversely affect the explosion proof compartment. The present invention may be placed any place on an explosion proof compartment because orientation is not a problem.

DETAILED DESCRIPTION

Figure 1:
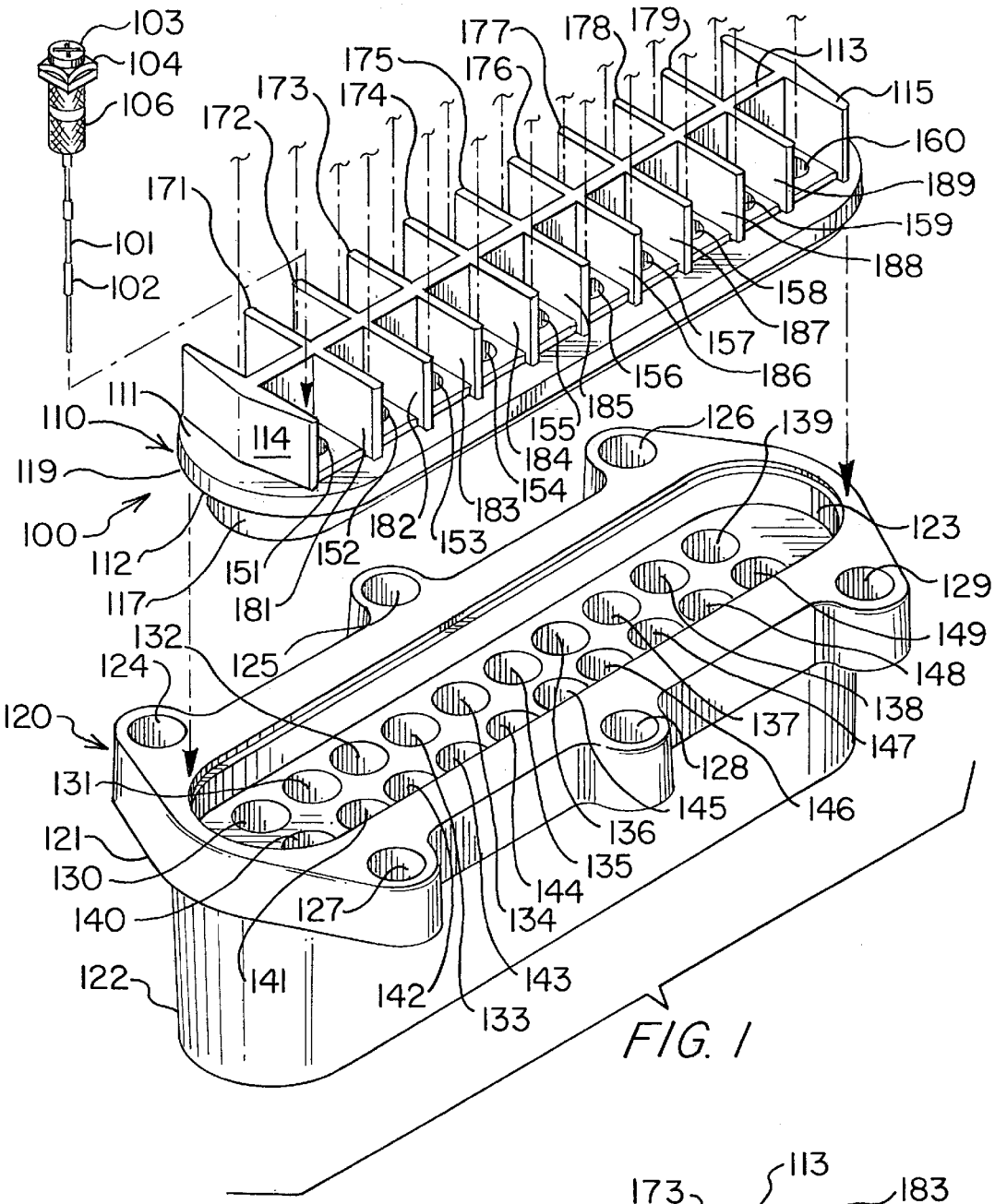
FIG. 1 illustrates an exploded view of the components of a one possible exemplary preferred embodiment of the present invention.
Figure 4:
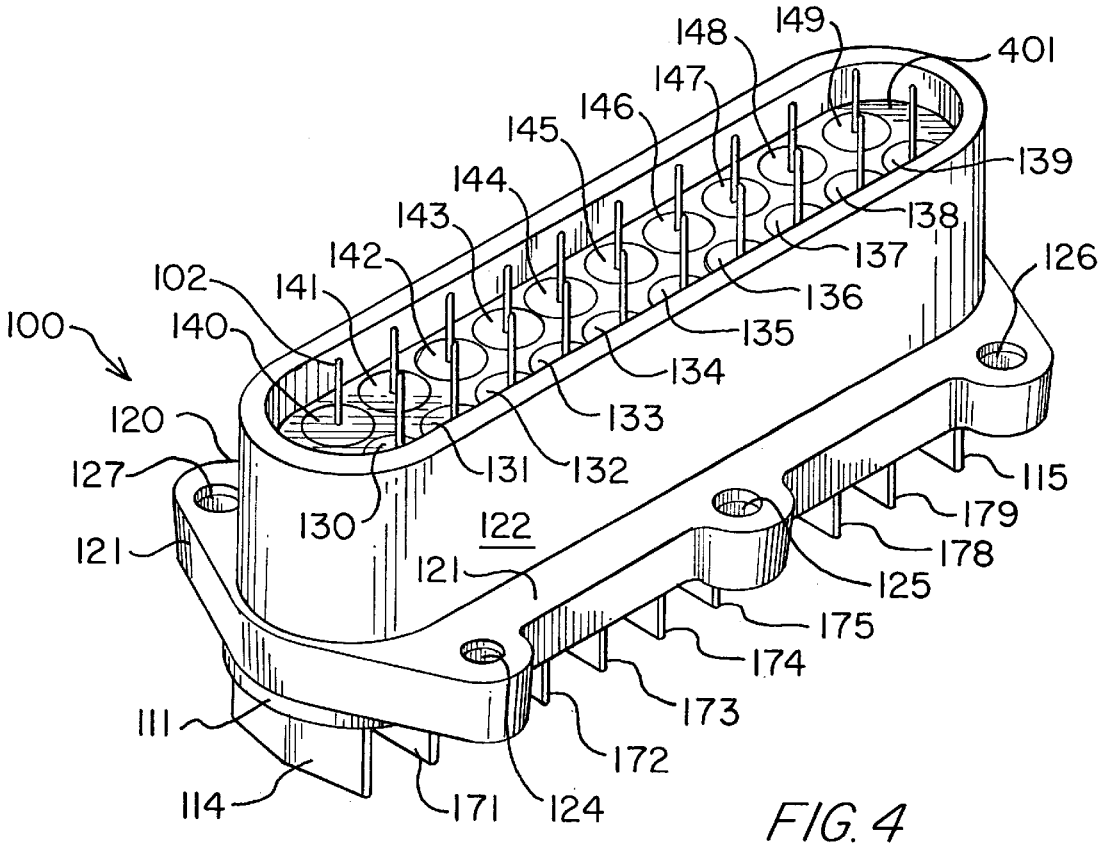
FIG. 4 illustrates an assembled bottom side view of the embodiment of FIG. 1.

FIG. 1 illustrates an exploded view of one possible preferred embodiment of the present invention. The three main components of explosion proof feedthrough connector 100 are a plurality of conductors represented by pin 101, a terminal housing 110, and explosion proof base 120. Terminal housing 110 is affixed to explosion proof base 120 which fits into an opening in an explosion proof compartment 602 (Shown in FIG. 6). The plurality of conductors are received into a first row of openings 151–160 and a second row of openings (not shown in FIG. 1) in terminal housing 110. The conductors extend through the terminal housing 110 into mated openings 130–149 in explosion proof base 120. The conductors further extend through explosion proof base 120 and protrude into the explosion proof compartment 602 (as shown in FIG. 4).

Each of the plurality of conductors has a body which extends from a terminal head. The body of each conductor is driven into terminal housing 110 to secure the conductor in place. The terminal head of the conductor remains exposed above the surface of terminal housing 110. The body of the conductor extends through the entirety feedthrough connector 100 and protrudes into the interior of the explosion proof compartment 602 on the other side of feedthrough connector 100 (shown on FIG. 6).

Figure 6:
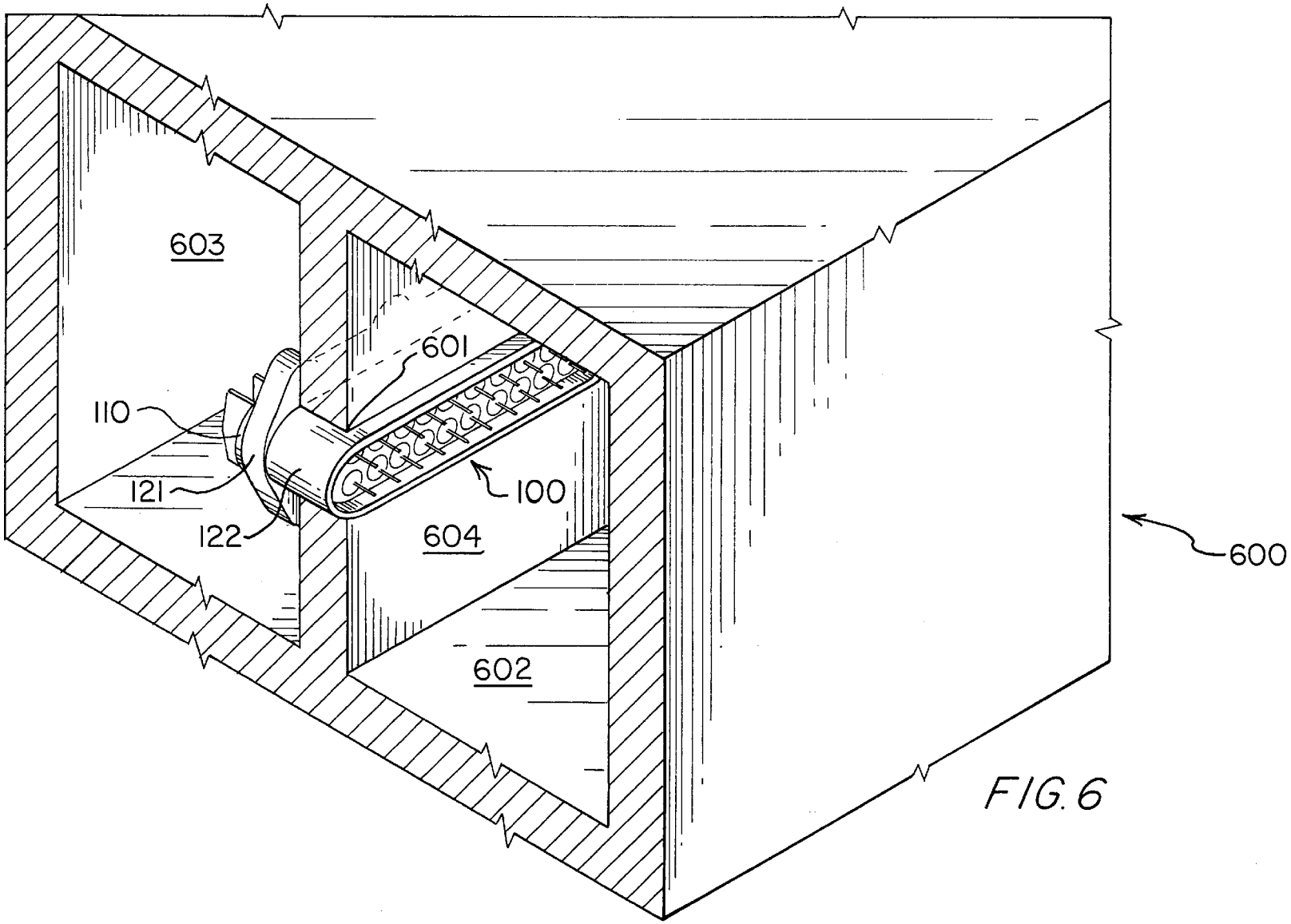
FIG. 6 illustrates a side view of the embodiment of FIG. 1 inside an opening in a explosion proof housing.

In the preferred embodiment, each of the conductors is a pin 101 which is made of a conductive material and connects circuits inside explosion proof compartment 602 with exterior circuits in compartment 603 (Shown on FIG. 6). Screw 103 of pin 101 extends through an opening (not shown) of captive cone washer 104 and is threaded into a hole (not shown) in head 106 of pin 101. Captive cone washer 104 and screw 103 provide a terminal connector on pin 101. Shafts 102 of each of pins 101 extend through the first row of openings 151–160 and second parallel row of openings (not shown in FIG. 1) of terminal housing 110 and openings 130–149 of explosion proof base 120. The lower end of shaft 102 of pin 101 protrudes from explosion proof base 120 into the interior of the compartment. In the preferred embodiment, head 106 of pin 101 has a larger radius than an opening in terminal housing 110 and must be driven into the opening which secures pin 101 in place.

Terminal housing 110 is made of a nonconductive material and houses the plurality of pins 101. Platform 119 of terminal housing 110 has a top surface 111 and a bottom surface 112 which are substantially flat, parallel surfaces. The pins 101 are driven into the openings of first row of openings 151–160 and second row of openings (not shown in FIG. 1) and extend through platform 119 from top surface 111 to bottom surface 112. In the preferred embodiment, platform 119 is substantially oval shaped with circular ends and elongated substantially parallel sides. First row of openings 151–160 and second row of openings (not shown in FIG. 1) are aligned along the longitudinal axis of platform 119. Any number or alignment of conductors may be used and it is the designer's choice as to the number and alignment of openings as well as the shape of terminal housing 110.

U-shaped partitions defined by upright walls on surface 111 of platform 119 are used in a preferred embodiment to prevent contact between a lead detached from a pin 101 terminal and a lead connected to an adjacent terminal. The u-shaped partitions also prevent arcing between terminals. Central wall 113 is substantially parallel to the longitudinal axis and divides a first row of openings 151–160 from a second row of openings (not shown in FIG. 1). Walls 171–179 and 181–189 branch orthogonally from central wall 113 and complete the u-shaped partitions for each terminal. End walls 114 and 115 at either end of central wall 113 complete the u-shaped partitions for the end terminals.

The bottom surface 112 of terminal housing 110 is affixed to the outer surface of explosion proof base 120. A mating ring 117 on bottom surface 112 is mated with cavity 123 of explosion proof base 120. Mating ring 117 surrounds first row of openings 151–160 and the second row of openings (not shown in FIG.1 ) on surface 112 of terminal housing 110. In the preferred embodiment, mating ring 117 is substantially the same shape as platform 119. Mating ring 117 and cavity 123 align first and second rows of openings in terminal housing 110 with openings 130–149 in explosion proof base 120. Terminal housing 110 is affixed to explosion proof base 120 with an adhesive or by some other method.

Explosion proof base 120 is made of a material that can withstand the pressure caused by an explosion and is positioned in the opening of an explosion proof compartment (shown in FIG. 6). Face plate 121 of explosion proof base 120 is affixed to the exterior wall of explosion proof compartment 602 (Shown in FIG. 6) and has cavity 123 which receives mating ring 117 to affix terminal housing 110 to face plate 121. A plurality of openings 130–149 are on the bottom surface of cavity 123. Openings 130–149 extend through base 120 to a bottom side inside the housing and each opening 130–149 is mated to one of the openings in first row of openings 151–160 or second row of openings (not shown) in terminal housing 110. In the preferred embodiment, a plurality of protrusions on face plate 121 of explosion proof base 120 contain holes 124–129 which receive bolts (not shown) in order to fasten explosion proof base 120 to the explosion proof compartment. Other methods of fastening feedthrough connector 100 to the compartment can be used.

Feedthrough boss 122 of explosion proof base 120 extends from a bottom side face plate 121 and through an opening 601 in the explosion proof compartment 602 into the interior of compartment 602 (Shown in FIG. 6). In the preferred embodiment, feedthrough boss 122 is cylindrically oval shaped similar to terminal housing 110 with circular ends and substantially parallel sides. Openings 130–149 extend through feedthrough boss 122 and open into the interior of the housing. The pins 101 extend through openings 130–149 and ends of the shafts 102 of the pins protrude from feedthrough boss 122 into the interior of the housing.

Figure 2:
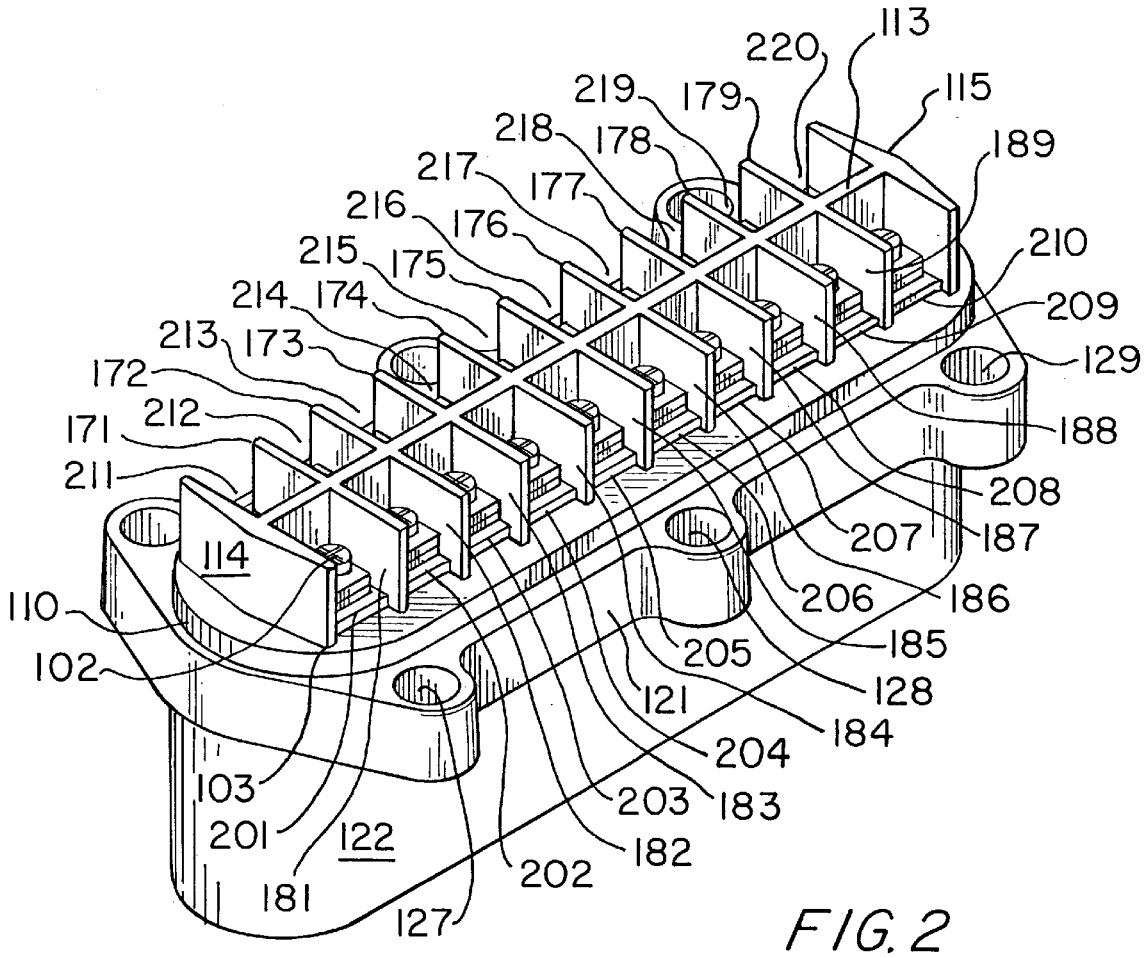
FIG. 2 illustrates an assembled view of the embodiment of FIG. 1.

FIG. 2 illustrates an assembled feedthrough connector. Terminal housing 110 is affixed to face plate 121. Partitions 113–115, 171–179 and 181–189 form terminal pockets 201–220 around each opening in the first and second rows of openings (not seen in FIG. 2) of terminal housing 110. Screws 102 and washers 103 attached to the plurality of pins (not seen in FIG. 2) are located on the bottom surface of terminal pockets 201–220 and provide the terminal connectors for leads (not shown) to be attached to pins 101.

Figure 3:
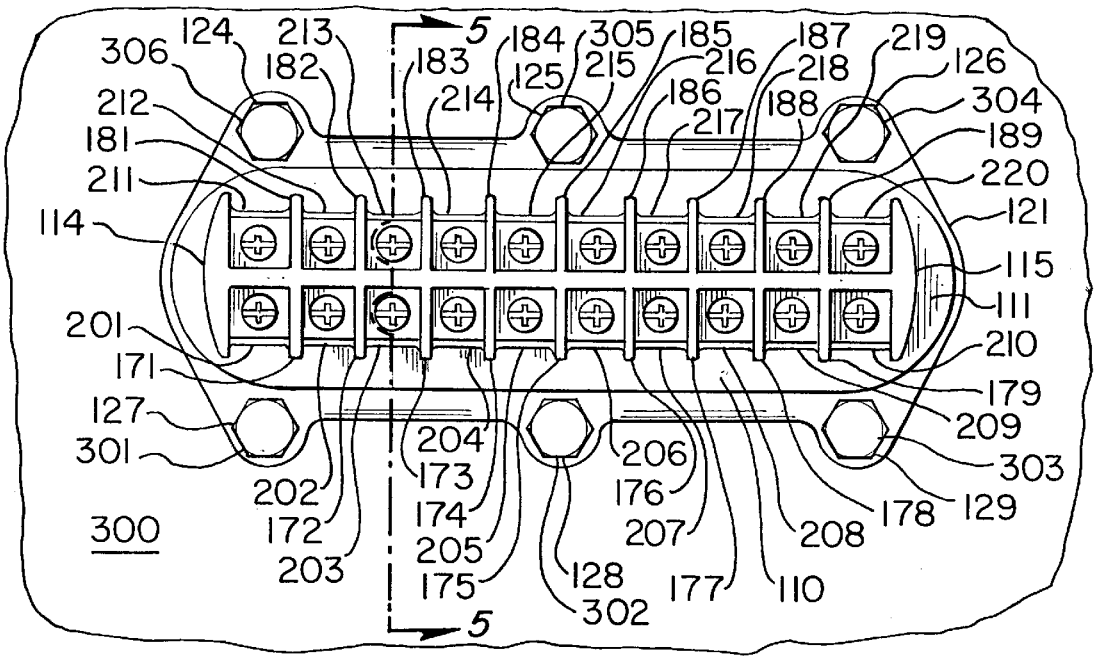
FIG. 3 illustrates a top side view of the embodiment of FIG. 1 inside an explosion proof housing.

FIG. 3 illustrates a topside view of a feedthrough connector fitted in opening (not shown) of explosion proof compartment 300. Face plate 121 is affixed to the exterior of compartment 300 by bolts 301–306 which extend though openings 124–129 in face plate 121. The type of bolt used is a design choice left to the maker and is not essential to the present invention. Further, other methods of fastening feedthrough connector 100 to the compartment wall may be used. Terminal housing 110 is affixed to the top side of face plate 121. Upright walls 113–115, 171–179 and 181–189 on top of surface 111 of terminal housing 110 form terminal pockets 201–220 which each contain a terminal connector for each of the plurality of conductors.

FIG. 4 illustrates a bottom side view of an assembled feedthrough connector 100. The end of the shaft 102 of each pin extends through openings 130–149 and protrudes from the bottom surface of feedthrough connector 100. This allows a maker of the housing to easily connect interior circuits to the pins inside the housing. The bottom surface of feedthrough 100 has a recessed reservoir 401 which is filled with a potting material 500 (shown in FIG. 5) to prevent an explosion or flame from passing through one of pass through openings 130–149.

Figure 5:
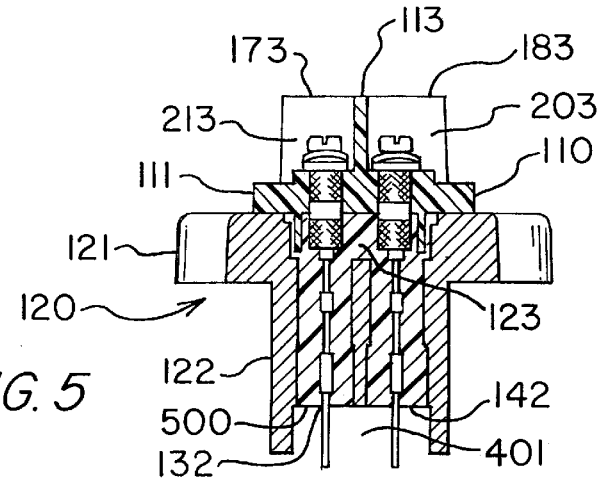
FIG. 5 illustrates a cross sectional view of the embodiment FIG. 1.

FIG. 5 is a cross sectional view of a feedthrough that shows potting material 500 in the feedthrough. Potting material 500 is an epoxy or other filling material which seals the openings in feedthrough 100 to prevent a flame or explosion from escaping through the openings. In FIG. 5, openings 132 and 142 illustrate typical mated openings in feedthrough base 120. At a minimum, potting material 500 must fill the openings in feedthrough base 120. In the preferred embodiment, potting material 500 also substantially fills reservoir cavity 401 and cavity 123 of base 120 to ensure the opening is completely sealed. In alternative embodiments, it is contemplated that other methods of sealing the openings may be used. One such alternative method can be forming the base around the conductors by injecting potting material 500 into a mold to form a feedthrough.

FIG. 6 illustrates a cross section view of feedthrough 100 in opening 601 which is an opening in a common wall 604 of compartments 602 and 603. In the preferred embodiment, explosion proof compartment 602 contains internal circuitry (not shown) and compartment 603 contains exterior circuitry (not shown).

Feedthrough connector 100 connects the internal circuitry in explosion proof compartment 602 to external circuitry in compartment 603. Base plate 121 and terminal housing 110 are affixed to wall 604. Feedthrough boss 122 extends through opening 601 into the interior of housing 602. In the preferred embodiment, feedthrough boss 122 and opening 601 are fabricated so that a gap between any side of feedthrough boss 122 and opening 601 is determined by the length of feedthrough boss 122. Further, the length of feedthrough boss 122 is equal to the thickness of wall 604 in the preferred embodiment. This spacing prevents an explosion or flame from escaping through a gap regardless of the use of gaskets or other type of seal in the opening.

The above disclosed embodiment is one preferred embodiment of an explosion proof connector of the present invention. Although a specific embodiment of the present invention is disclosed herein it is expected that persons skilled in the art can and will design alternative explosion proof connectors that are within the scope of the following claims either literally or through the doctrine of equivalents.

What is claimed is:

1. An explosion proof feedthrough connector comprising:

a terminal housing having a first surface and a second surface;

a plurality of conductors;

a plurality of openings extending through said terminal housing from said first surface to said second surface for receiving said plurality of conductors;

an explosion proof base having a top side and a bottom side, said top side being affixed to said second surface of said terminal housing;

a feedthrough boss protruding from said bottom side of said explosion proof base into an opening in an explosion proof housing and being fabricated to fit securely into said opening with a minimal gap between said feedthrough boss and said opening to provide a minimal flamepath;

a plurality of openings extending though said explosion proof base from said top side to said bottom side, wherein each of said openings in said base is mated to a corresponding one of said plurality of openings in said terminal housing; and each of said plurality of conductors extends through one of said plurality of openings in said terminal housing, further extends through an opening in said base mated to said one opening in said terminal housing and protrudes from said bottom side of said explosion proof base.

2. The explosion proof feedthrough connector of claim 1 further comprising:

a plurality of u-shaped partitions defined by upright walls on said first surface of said terminal housing for providing substantially u-shaped enclosures of each of said plurality of openings through said terminal housing to isolate adjacent terminals.

3. The explosion proof feedthrough connector of claim 1 further comprising:

a plurality of cavities in said explosion proof base defined by space surrounding each said plurality of conductors in each of said plurality of openings in said explosion proof base; and a potting material filling said plurality of cavities to prevent a spark from escaping from inside an explosion proof compartment of said explosion proof housing through said connector.

4. The explosion proof feedthrough connector of claim 3 further comprising:

a recessed reservoir on a bottom side of said feedthrough boss; and said potting material substantially filling said recessed reservoir.

5. The explosion proof feedthrough connector of claim 1 further comprising:

a mating ring on said second surface of said terminal housing defined by an upright wall surrounding said plurality openings on said second side of terminal housing;

a recessed cavity in said top side of said explosion proof base for receiving said mating ring on second side of said terminal housing which is mated with said recessed cavity to align each of said plurality of openings through said terminal housing with one of said plurality of openings through said explosion proof base.

6. The explosion proof feedthrough connector of claim 1 wherein said first surface and said second surface of said terminal housing are substantially parallel planar surfaces, each end of said terminal housing is circular and opposing sides of said terminal housing are substantially parallel.

7. The explosion proof feedthrough connector of claim 6 wherein said openings in said first side of terminal housing are aligned in rows substantially parallel to a longitudinal axis of said planar surfaces of said terminal housing.

8. The explosion proof feedthrough connector of claim 7 further comprising:

a longitudinal wall substantially parallel to said longitudinal axis of said first surface of terminal housing between said rows of openings on said first surface of said terminal housing;

a plurality of walls orthogonal to said longitudinal wall and positioned between each of said openings in each of said rows on said first surface of said terminal housing; and said longitudinal walls and said plurality of walls defining u-shaped partitions for preventing contact of a lead detached from one terminal and a lead connected to an adjacent terminal.

9. The explosion proof feedthrough connector of claim 1 wherein said gap between said feedthrough boss and said opening are determined by the length of said feedthrough boss extending into said opening.

10. The explosion proof feedthrough connector of claim 1 wherein each of said plurality of conductors comprises:

a pin;

a screw on a head of said pin; and a washer proximate said head of said pin;

a threaded hole in said head; and said screw extending through said washer and into said threaded hole of said pin for providing a terminal connection to said pin.

11. An explosion proof feedthrough connector system in an explosion proof compartment comprising:

an opening in said compartment;

a terminal housing positioned outside of said compartment having a first and second side;

a plurality of conductors;

a plurality of openings in said terminal housing extending from said first side to said second side for receiving said plurality of conductors;

an explosion proof base fitting in said opening of said compartment, said base having a top side affixed to said second side of said terminal housing and a bottom side fabricated to fit with into said opening with a minimal gap between said bottom side of said base and the edges of said opening in said compartment;

a plurality of openings in said base extending through said base from said top side to said bottom side, wherein each of said openings in said base is mated to a corresponding one of said plurality of openings in said terminal housing; and each of said plurality of conductors extending through one of said plurality of openings in said terminal housing through an opening in said base mated to said one opening in said terminal housing and protruding from said bottom side of said base.

* * * * *

UNITED STATES PATENT AND TRADEMARK OFFICE

CERTIFICATE OF CORRECTION

PATENT NO. : 6,109,979
DATED : August 29, 2000
INVENTOR(S) : Robert Barclay Garnett It is certified that error appears in the above-identified patent and that said Letters Patent is hereby corrected as shown below:

Column 3,
Line 6, replace "unshaped" with -- u-shaped --.

Column 8,
Line 36, replace "plurality of conductors" with -- plurality of solid conductors --.

Signed and Sealed this

Second Day of October, 2001

*Attest:*

Nicholas P. Godici

*Attesting Officer*

NICHOLAS P. GODICI
*Acting Director of the United States Patent and Trademark Office*